US005158341A

United States Patent [19]

Lewins et al.

[11] Patent Number: 5,158,341

[45] Date of Patent: Oct. 27, 1992

[54] METHOD OF STEERING A MINING MACHINE

[75] Inventors: Foster Lewins, Mickleover; Bruce N. Roth, Burton-On-Trent; John S. Wykes, Chellaston, all of England

[73] Assignee: Coal Industry (Patents) Limited, London, England

[21] Appl. No.: 656,642

[22] Filed: Feb. 15, 1991

[30] Foreign Application Priority Data

Feb. 15, 1990 [GB] United Kingdom ..... 9003468

[51] Int. Cl.[5] ..... E21C 35/12; E21C 35/24

[52] U.S. Cl. ..... 299/1.1; 299/1.6

[58] Field of Search ..... 299/1, 30, 42; 364/420, 364/689

[56] References Cited

U.S. PATENT DOCUMENTS 4,228,508 10/1980 Benthaus ..... 299/1 X
4,643,482 2/1987 Wolfenden ..... 299/1
4,976,495 12/1990 Lewins et al. ..... 299/1

FOREIGN PATENT DOCUMENTS 2027548 2/1980 United Kingdom ..... 299/1
2092641 8/1982 United Kingdom ..... 299/1

*Primary Examiner*—David J. Bagnell
*Attorney, Agent, or Firm*—Stevens, Davis, Miller & Mosher

[57] ABSTRACT

A method of steering a double-ended ranging drum type mining machine. The method includes the steps of positioning a first current cut follower at or substantially adjacent the center of the machine. A second previous cut follower is positioned at or substantially adjacent the center of the machine. A tilt measurer determines machine tilt and an estimator estimates mineral thickness and generates algorithms whereby height differences between a current and a previous cut roof can be calculated to control and steer the leading cutting drum; the algorithms are generated in such a manner that cumulative errors along or towards a mine face are minimized or eliminated.

10 Claims, 1 Drawing Sheet

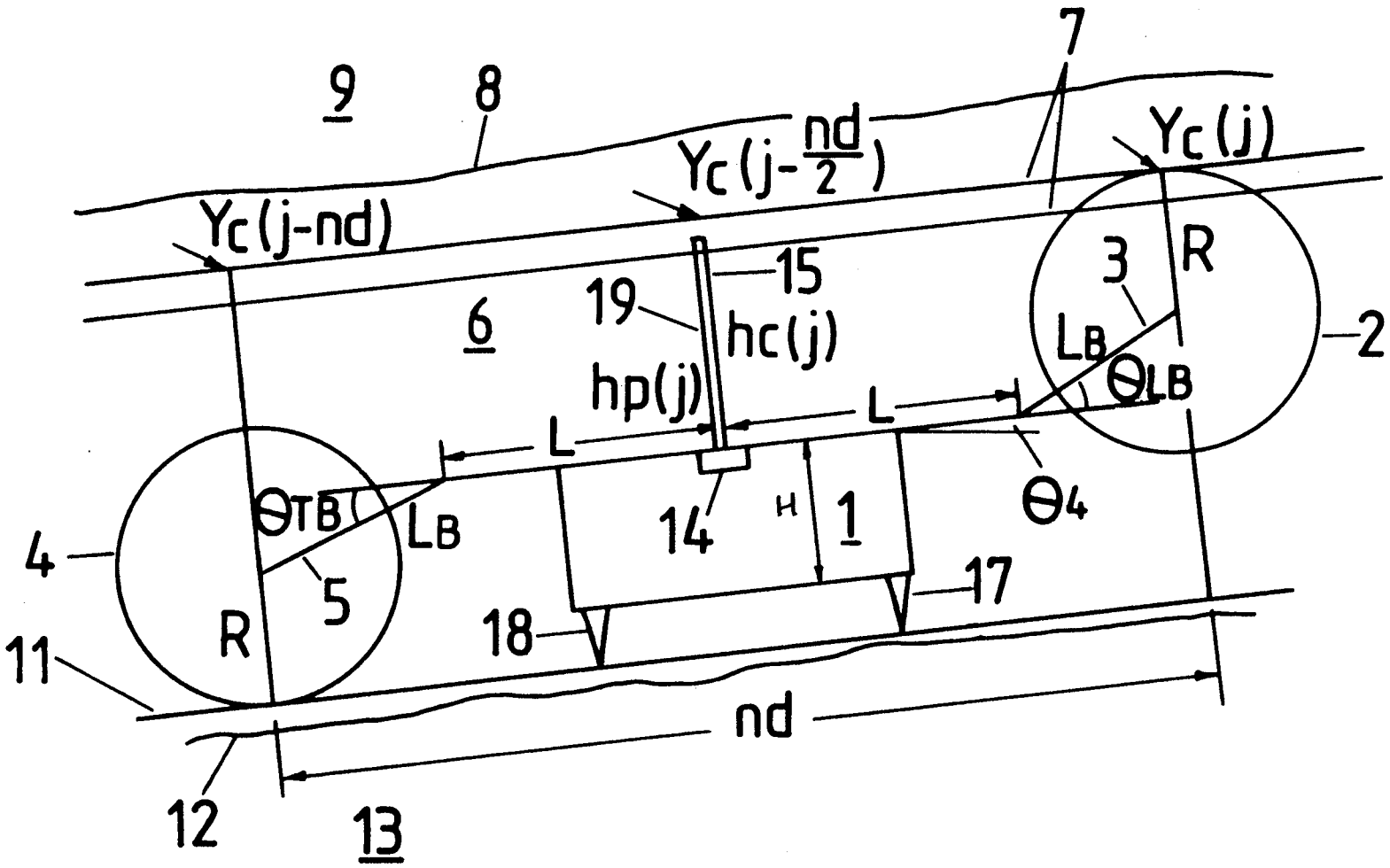
2
Yc(j)
R
3
LB
θLB
7
θ4
17
L
1
H
Yc(j-nd/2)
15
hc(j)
14
19
hp(j)
nd
L
18
8
6
LB
9
Yc(j-nd)
θTB
5
R
13
12
4
11

METHOD OF STEERING A MINING MACHINE

BACKGROUND OF THE INVENTION

1. Field of the Invention

This invention relates to a method of steering a mining machine and is particularly concerned with the steering of a double-ended ranging drum mining machine.

2. Description of the Related Art

Such machines are used particularly in mining minerals, such as coal, where the desired mineral is extracted from a seam by a long-wall mining method. In the long-wall mining method the machine successively traverses a face which may be of the order of 250 m in length, cutting mineral as it goes. The machine carries a rotating cutting drum at each end of its ranging arms and one of the drums cuts, as a leading drum, the top of the seam while the other, the trailing drum, cuts the lower part of the seam.

It is necessary in order to maximise the economics of the mining operation to ensure that the fullest extraction of the desired mineral from the seam is taken, without there being any excursion by the cutting drum into the overlying or underlying strata. This is usually achieved by determining that a desired thickness of the mineral is left at the roof and the floor. Roof coal also helps in stabilizing the roof conditions. A typical roof thickness is of the order of 100 mm.

One way in which this roof thickness is maintained is by measuring the amount of natural gamma radiation emitted by the adjacent strata as described in our British Patent No 1 526 028. This radiation can be picked up by a gamma detector situated on the machine and the strength of the signal received is dependent on the attenuation of the signal by the quantity of roof left after the cutting operation. If the signal is attenuated too far as the thickness increases, then a correction steering signal can be given to alter the angle of the ranging arm to alter the cut so that a lesser thickness of roof is left.

However, in order to achieve this, it is also necessary to measure physically the roof step, i.e. the difference in roof heights between the previous pass cut roof, at which a roof coal thickness measurement is available, and the leading drum, in order that further steering of the drum can take place. Currently, this measurement is usually effected by using a roof follower attached to the ranging arm itself. This follower contacts the roof, cut on the previous pass, but adjacent to the drum, and physically follows its contours. As deviations occur, a transducer produces electrical signals which can be fed to a comparator for altering the angle of the ranging arm as necessary.

The steering may also be controlled by a factor which takes account of the inclination or tilt of the machine towards the face.

Particularly in deep seams, the roof follower, which is located in a vulnerable position close to the drum, may be a very long cantilevered arm and thus quite flexible and liable to damage, for example by mineral falling from the roof or by irregularities in the roof itself.

In our co-pending UK Patent Application No. 90 02956.2 (Publication No. 2241006A) we have described a method of measuring various parameters for steering respectively the leading and the trailing drums of a mineral mining machine using a current cut follower at or near the centre of the machine. However, although both algorithms were shown not to be subject to propagating errors and the trailing drum algorithm was shown to be subject to geometrical transducer errors alone, the leading drum algorithm was also dependent on multiple coal thickness measurements and their associated errors.

It is an object of the present invention to provide an alternative method of steering which employs an additional roof follower placed in the previous cut in order to reduce the errors of the leading drum algorithm. Through the introduction of a strategically placed previous cut roof follower, or roof height sensor, at the same along face position as a current cut roof follower an algorithm will be developed which will reduce all steering control variables to local height differences (effectively local cut roof height differences), the angles and coal thickness measurements.

SUMMARY OF THE INVENTION

According to the present invention, a method of steering a double-ended ranging drum mining machine in a seam in which the machine has a leading cutting drum arranged to cut mineral from a face to a distance at or near the interface of the mineral and an adjacent roof stratum, and a trailing cutting drum arranged to remove residual material from the face and to form a floor, characterised in that the method includes the steps of positioning a first current cut roof follower means at or adjacent the centre of the machine, a second previous cut follower means at or adjacent the centre of the machine, measuring the machine tilt using third means, estimating coal thickness using fourth means and generating algorithms (as defined hereinafter) therefrom whereby the height differences between the points on the current and previous cut roof can be calculated to control and steer the leading cutting drum, the algorithm being generated in such a manner that cumulative errors along or towards the face are minimised or eliminated.

The height differences are calculated and may be used immediately or stored in memory for future use.

The first roof follower means may be one or more roof followers or roof height sensors measuring the height of the machine below the current cut roof but is preferably a single follower placed at or adjacent the centre of the machine. The roof height sensors are of the non-contacting type and may be electromagnetic, optical or ultrasonic.

The second roof follower means may be a roof follower or a roof height sensor measuring the height of the machine below the previous cut roof, or the difference in current and previous roof heights, at or adjacent the centre of the machine.

The third means will include instruments for determining the tilt of the machine towards the face and the tilt of the machine along the face; these instruments may include inclinometers for measuring tilt in each direction.

Preferably the fourth means for determining the thickness of the mineral left at the roof is a natural gamma sensing device and will be situated at or adjacent the centre of the machine body.

The leading drum algorithm uses stored and present height differences between the current cut follower and leading drum and between the roof followers themselves or previous cut follower and leading drum as the basis for an estimate of the required roof step between current and previous cut roofs at the leading drum.

The trailing drum algorithm uses the stored current cut height difference between current cut follower and leading drum, at such a delay that they approximately coincide with the present trailing drum and follower along the face positioned to provide the desired extraction. This case is considered in our co-pending UK Patent Application No. 90 02956.2 (Publication No. 2241006A) and is not discussed further in this specification.

BRIEF DESCRIPTION OF THE DRAWINGS

The sole FIGURE is a schematic representation of a side view of a steerable mining machine according to the invention.

In order to assist in the understanding of the invention, the method of steering a machine in accordance with the present invention will now be described with reference to the schematic accompanying drawing and suitable algorithms deduced therefrom for the case of a current cut follower placed at the centre of the machine.

DESCRIPTION OF THE PREFERRED EMBODIMENTS

In the drawing, the body of the machine is shown at 1 and it carries a leading cutting drum 2 at the end of a ranging boom or arm 3 and a trailing cutting drum 4 at the end of a ranging boom or arm 5.

The drum 2 is arranged to cut in a seam 6 of a desired mineral, in this case coal, to form a roof 7 having a thickness on average of typically 100 mm at its interface 8 with the overlying stratum 9.

The body of the machine 1 carries at 14 a natural gamma sensor substantially at the centre of its top surface and has two followers 15, 19 in the form of roof height sensors or an arm extending normally from the surface of the body 1 to the roof 7. Both the natural gamma sensor and the roof follower 15 measure the current cut roof in the wake of the leading drum. The roof follower 19 measures the previous cut roof or the difference in heights between current and previous cut roofs.

The body 1 is supported on shoes 17 and 18 which are the leading and trailing shoes respectively.

In this example, it is assumed that the face is not horizontal but is at an angle $\Theta t$ to the horizontal.

There will be reference to an arbitrary datum line from which vertical distances are assumed measured. However, it will be shown that the algorithm can be made to depend on local height differences only, so avoiding any cumulative errors.

The roof at the point of contact of the leading drum is assumed to be at a vertical position $Y_c(j)$ with respect to the arbitrary datum and the position of the roof above the trailing drum is at a position $Y_c(j-nd)$; the height of the roof between these two points and above the sensor 14 and at the point where it is contacted directly by the roof follower is $Y_c(j-nd/2)$, and the distance between the centre points of the drum is nd. Each drum 2 and 4 has a radius R and the ranging arms 3 and 5, of length LB, are pivoted about the body at a distance L from the centre of the machine body 1 at a height H above the shoes. The ranging arms make an angle $\Theta_B$ to the top surface of the machine 1. The top surface of the machine body at its centre is at a distance $h_c(j)$ and $h_p(j)$ from the current and previous cut roofs respectively at the point $Y_c(j-nd/2)$. The distance nd is made up of a number of increments (MMADD intervals where MMADD means machine movement and direction detector) and it is assumed that these increments and distance nd will be constant and independent of other factors such as boom angle.

The provision of the current roof height sensor 15 enables the difference in vertical between the roof being cut by the leading drum and the roof being measured by the sensor 14 to be directly determined without any use of an external reference: thus $$\begin{aligned}\delta Y_c(j) &= Y_c(j) - Y_c(j - nd/2) \\ &= [R - h_c(j)]\cos\theta t + L_B \cdot \sin[\theta_{LB}(j) + \theta_t(j)] + \\ &\quad L \cdot \sin\theta_t(j)\end{aligned} \tag{1}$$

where R is the radius of the drums 2 and 3.

The following notation is maintained for position: all roof parameters are labelled with their actual position in MMADD increment number but all machine positions and sensed data are given the position label of the leading drum position at that time.

The leading drum algorithm in this method makes use of the local measurement of roof step calculated at the centre of the machine. Reference to the drawing shows how a measured estimate of this roof step at a delay of $(j-nd/2)$ can be used to predict the required roof step (RS) at the leading drum given by $$\Delta(j) = Y_c(j) - Y_p(j) \tag{2}$$

where $\Delta(j) = RS(j) \cos \theta_t(j)$, RS(j) is roof step

If we take the height difference measured between the current and previous cut roofs above the centre of the machine to be $$\Delta pc = h_c(j) - h_p(j) \cos \theta_t(j) \tag{3}$$

then we can write for a differential roof height sensor $$Y_c(j-nd/2) = Y_p(j-nd/2) + \Delta_{pc} \tag{4}$$

However, we define $$Y_c(j) = Y_c(j-nd/2) + \delta Y_c \text{ where } \delta Y_c = \delta Y_c(j) \tag{5}$$

for the present cut and note that $$Y_p(j) - Y_p(j-nd/2) = Y_c'(j) - Y_c'(j-nd/2) \tag{6}$$

where the prime denotes the previous cut. Thus using (5) and (6) we can write $$Y_p(j) = Y_p(j-nd/2) + \delta Y_c' \tag{7}$$

If we add (4) and (5) then $$Y_c(j) = Y_p(j-nd/2) + \Delta_{pc} + \delta Y_c \tag{8}$$

Subtracting (7) from (8) and using (2) gives the required roof step $$\Delta(j) = \Delta pc + \delta Y_c - \delta Y_c' \tag{9}$$

Alternatively, we can use the height of each roof follower directly. Thus for the present cut we can write $$Y_c(j) = Y_p(j-nd/2) + \delta Y_{pc}, \text{ where } \delta Y_{pc} = \delta Y_{pc}(j) \tag{10}$$

where $\delta Y_{pc}(j)=[R-h_p(j)]\cos\theta+L_B\sin[\theta_{LB}(j)+\theta_t(j)]+L\sin\theta_t(j)$ (11)

Then a combination of (2), (7), (10) and (11) also gives the required roof step $$\Delta(j)=\delta Y_{pc}-\delta Yc' \quad (12)$$

(9) and (12) are of a closed loop form dependent only on current ($\Delta_{pc}$,$\delta Y_c$) and stored ($\delta Y_c'$) height differences. Adjustment of the boom height is given by the $L_B \sin[\theta_{LB}+\theta_t]$ term in $\delta Y_c$ so enabling the required roof step to be achieved.

Where a double pass unidirectional double ended ranging drums shearer mining method is being used both $\delta Y_c$ and $\delta Y_c'$ should be calculated using the expression given by (1) above. However, where a bi-directional or single pass system is employed the trailing drum for one direction of cut becomes the leading drum on the return pass. For the geometry in the drawing $\delta Y_c'$ will still be given by (1) but $\delta Y_c$ may be given by an expression of the form $$\delta Y_c=[R-h_c(j-nd/2)]\cos\theta_t(j-nd/2)-L\sin\theta t(j-nd/2)-LB\sin\theta[\theta_{TB}(j-nd/2)+\theta_t(j-nd/2)] \quad (13)$$

Where $\theta_t$ now refers to the drum taking the leading drum role. The labels of (j−nd/2) in (13), for the leading drum position, should be replaced by (j+nd/2) in order to replace positions from pass to pass.

The measured parameters on the right hand side of the equation (9) and (12) are all subject to largely independent errors and, although measurements from two strips are involved, there should be no build up of roof step errors from strip to strip as the actual roof height differences on a strip are directly measured and used for the next strip and all use of information from the previous strip is dropped once the current strip is completed. It does, however, require some additional help on the starting strip such as the use of another method of steering to initialise previous cut estimates for the leading drum.

As an example, if we take a 0.05 degree random tilt error and boom height/roof height measurement errors of about 3 mm, then we might expect a leading drum algorithm random error of about 8 mm; when coal thickness in included in the full algorithm this figure is likely to increase to 13 mm.

An alternative to this approach may be provided by using just the previous cut follower located at the machine centre for the second and subsequent cuts. Here, the roof height between follower and the drum centre are stored for use on the return cut and for the trailing drum algorithm.

The application of the techniques with the provision of two followers affords considerable redundancy in the event of either follower or coal thickness failing.

We claim:

1. A method of steering a double-ended ranging drum mining machine in a seam wherein the machine has a leading cutting drum disposed to cut mineral from a face to a distance at or near an interface of the mineral and an adjacent roof stratum, and a trailing cutting drum disposed to remove residual material from a face and to form a floor, said method including the steps of positioning a current cut roof follower means at or substantially adjacent the center of the machine, a previous cut follower means at or substantially adjacent the center of the machine, measuring machine tilt using tilt measuring means, estimating coal thickness using estimating means and generating algorithms therefrom, whereby height differences between points on the current and previous cut roof can be calculated to control and steer the leading cutting drum, the algorithms being generated in such a manner that cumulative errors along or towards said face are minimized or eliminated.

2. A method according to claim 1 in which the height differences are calculated and are used immediately or stored in memory for future use.

3. A method according to claim 1 in which the roof follower means comprises one or more roof followers or roof height sensors measuring the height of the machine below the current cut roof.

4. A method according to claim 3 in which a single follower is placed at or adjacent the center of the machine.

5. A method according to claim 1, in which the previous cut follower means comprises a roof follower or a roof height sensor means measuring the height of the previous cut roof, or the difference in current and previous cut roof heights, at or substantially adjacent the center of the machine.

6. A method according to claim 1 in which the tilt measuring means includes instruments for determining the tilt of the machine towards the face and the tilt of the machine along the face.

7. A method according to claim 6 in which the instruments include inclinometers for measuring tilt in each direction.

8. A method according to claim 1 in which the estimating means for determining the thickness of the mineral remaining at the roof comprises a natural gamma sensing device and is situated at or substantially adjacent the center of the machine.

9. A method according to claim 1 in which a leading drum algorithm uses stored and present height differences between the current cut roof follower and leading drum and between the roof followers themselves or a previous cut follower and leading drum as the a basis for an estimate of the required roof step between current and previous cut roofs at the leading drum.

10. A method according to claim 1, in which a trailing drum algorithm uses a stored current cut height difference between the current cut follower and the leading drum, at such a delay that said current cut follower and said leading drum approximately coincide with the present trailing drum and follower along said face and are positioned to provide desired extraction.

* * * * *